United States Patent [19]

Anderson

[11] 4,141,504

[45] Feb. 27, 1979

[54] CENTRAL FLOW NOZZLE SELECTOR

[75] Inventor: Arthur A. Anderson, St. Paul, Minn.

[73] Assignee: Specialty Manufacturing Company, St. Paul, Minn.

[21] Appl. No.: 806,760

[22] Filed: Jun. 15, 1977

[51] Int. Cl.[2] ..... B05B 1/16

[52] U.S. Cl. ..... 239/394; 239/396

[58] Field of Search ..... 239/394, 396

[56] References Cited

U.S. PATENT DOCUMENTS

| | | | |
|---|---|---|---|
| 464,335 | 12/1891 | Scott | 239/394 |
| 2,790,680 | 4/1957 | Rosholt | 239/396 X |
| 3,558,061 | 1/1971 | Hansen | 239/394 |
| 3,982,698 | 9/1976 | Anderson | 239/394 |

*Primary Examiner*—John J. Love

*Attorney, Agent, or Firm*—Jacobson and Johnson

[57] ABSTRACT

A multi-nozzle high pressure fluid sprayer which can be safely indexed to a selected nozzle while the sprayer is under high fluid pressure. The sprayer head contains an offset member having at least one fluid nozzle therein. The offset member can be rotated to align a selected nozzle with a source of high pressure fluid.

5 Claims, 5 Drawing Figures

FIG. 1
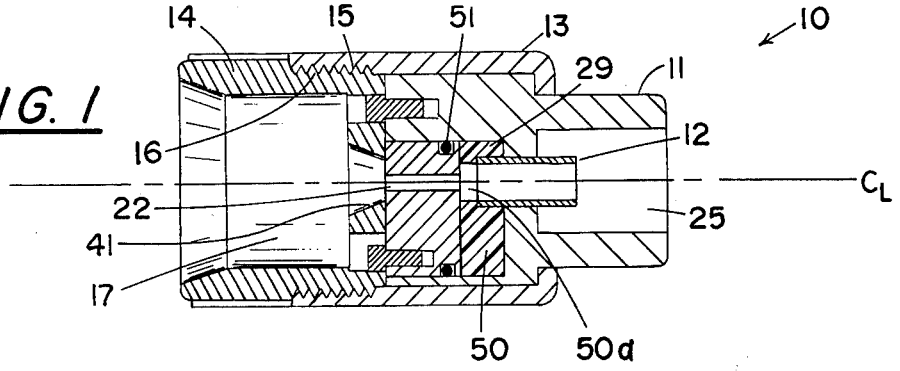
FIG. 2
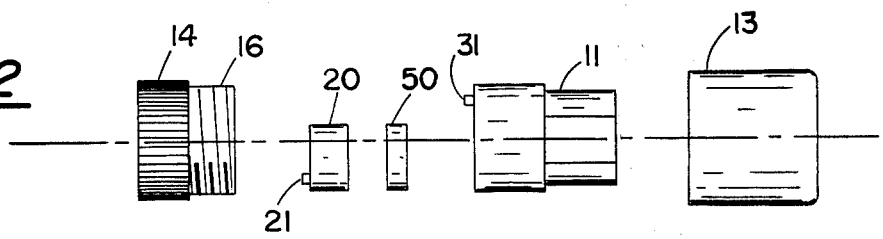
FIG. 4
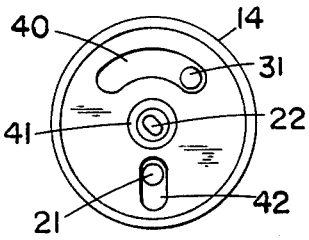
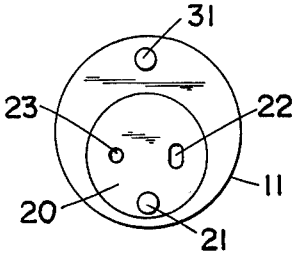
FIG. 3
FIG. 5
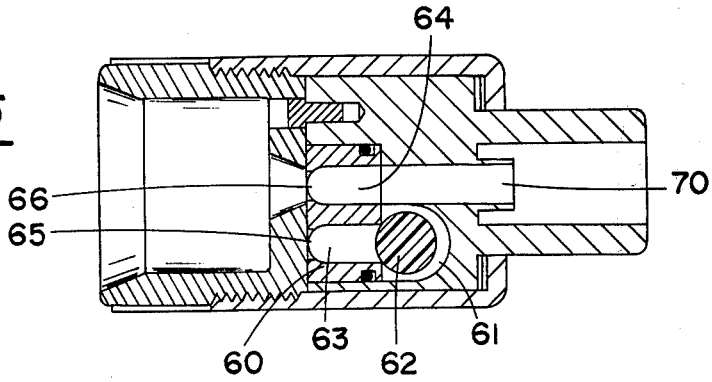

CENTRAL FLOW NOZZLE SELECTOR

BACKGROUND OF THE INVENTION

1. Field of the Invention

This invention relates generally to high pressure sprayers and more specifically, to a high pressure sprayer indexing assembly which allows an operator to select the appropriate fluid condition by rotating the sprayer head.

2. Description of the Prior Art

The concept of sprayers with indexing nozzles is well known as indicated by the Piggot patent 3,516,611 and the Bruggeman patent 3,777,028. However, these prior art sprayers have serious shortcomings which makes them difficult to use, and in some cases, potentially hazardous to use. One of the problems of the prior art high pressure indexable sprayers is the difficulty for the operator to safety index the nozzle, i.e., select a particular nozzle. In most cases the high pressure fluid must be shut off before indexing. If the high pressure is not shut off the seals in the sprayer will be ruined during the indexing.

The cause of indexing problems with high pressure fluid is that the high pressure fluid acting on one side of the seal, partially displaces the seal from its required total confinement for indexing. Consequently, indexing results in a pinching, cutting or total destruction of the seal as the nozzle is indexed, i.e., rotated within the sprayer head. To avoid this problem, most commerical high pressure sprayers carry warnings such as "index with pressure off." Even so, indexing under pressure, whether intentional or accidental, is the most common cause of seal failure in indexing sprayers. Not only is seal destruction a problem but the destructive force of high pressure fluid stream, which may be under pressure as high as 1,000 psi., can be potentially hazardous to an operator should the operator accidentally come in contact with high pressure stream of fluid. Consequently, some indexing sprayers have provided bleed ports in the event of seal failure to ensure high pressure fluid is directed away from the operator.

An improvement to the state of the art is shown in the Arthur A. Anderson U.S. Pat. No. 3,982,698 which shows two nozzles each having a seal therearound. Both nozzles are located on the end face of a cup-shaped circular head which is rotatably mounted and held on the body of the sprayer by a threaded cap. A fluid passage for supplying high pressure fluid is located in line with the set of nozzles. A further seal comprising an O ring and a pair of thrust washers is located around the body of the sprayer and between a ridge in the body of the sprayer in the back of the threaded cap. The thrust washers allow rotation of the head in the threaded cap with respect to the sprayer body. The O ring seals the high pressure fluid within the sprayer. A set of resilient seals which are located coaxially around the inlet of each of the nozzles have high pressure fluid on both sides of the seal so that the seals are not under any fluid pressure which would force the seals out of the groove. Thus, this improvement to the prior art shows the feature of the pressure being equalized on both sides of the seal so the nozzle can be indexed without fear of destroying the nozzle seals. The present invention provides the further improvement of providing a nozzle which can be safely indexed under high pressure without destroying the seals of the unit.

SUMMARY OF THE INVENTION

Briefly, the present invention comprises an indexable spray head in which there is provided a rotatable insert which is located off-center of the center line of the nozzle. The rotatable insert contains a nozzle which can be rotated into alignment with the source of high pressure fluid. The sealing arrangement is provided by elastomer material which is located within the nozzle housing.

BRIEF DESCRIPTION OF THE DRAWINGS

FIG. 1 is a cutaway side view of my invention;

FIG. 2 is an exploded view of my invention;

FIG. 3 is an end view of the off-center rotatable insert;

FIG. 4 is an end view of my invention; and

FIG. 5 is a cutaway side view of an alternate embodiment of my invention.

DESCRIPTION OF THE PREFERRED EMBODIMENT

Referring to FIG. 1, reference numeral 10 identifies my assembled indexable sprayer which comprises a main body 11, a threaded cap 13 and a rotatable head 14 which is held in engagement with threaded cap 13 by thread sections 15 and 16. Main body 11 is adaptable to be connected to a source of high pressure fluid, i.e., in excess of 500 psi.

Reference to FIGS. 1 through 4 will reveal the detailed features of my sprayer. In operation, high pressure fluid flows through a fluid inlet passage 25 located in main body 11. Fluid then flows through the outward extending entrance section 12 and into a fluid passage 50*a* located in a cylindrical elastomer seal 50. Elastomer seal 50 is located in a chamber 29 in main body 12 with the geometric center of elastomer seal 50 being offset from the geometric center line $C_L$ of my sprayer. Also positioned offset of geometric center line $C_L$ and within chamber 29 is a rotatable insert 20 which contains fluid nozzles 22 and 23. An O ring 51 is located around insert 20 for providing a uniform frictional resistance to rotation of insert 20 within chamber 29. Insert 20 also contains an outward extending cylindrical member 21 which forms slidable engagement in an elongated slot 42 located in rotatable head 14 (FIG. 4). Located on body member 11 is a similar outward extending cylindrical member 31 which similarly forms slidable engagement in an elongated semicircular opening 40 located in rotatable head 14. Rotatable head 14 also includes a central opening 41 which is located on the geometric center line $C_L$ of sprayer 10. In the embodiment positioned as shown in FIG. 1, fluid flows through nozzle 22 and through central opening 41. When rotatable head 14 is rotated with respect to body 11, pins 31 and 21 coact to produce rotation of insert 20. That is, rotation of rotatable head 14 allows pin 31 to slide in opening 40 and and pin 21 to slide in opening 42. Insert 20 can be rotated within chamber 29 to bring nozzle 23 in alignment with fluid passage 12 as shown in FIG. 1. By rotating insert 20 in the opposite direction, nozzle 22 can be brought into alignment with the fluid passage 12. Thus, by rotation of insert 20 within body 11 the operator can bring either nozzle 22 or 23 into the central flow position. To visualize the action of rotating the nozzles into alignment with passage 12*a*, a reference to FIG. 3 and FIG. 4 will be helpful as FIG. 3 isolates rotatable insert 20 and main body 11.

Pin 21 and slot 42, as shown in FIG. 4, allow the operator to have an external means to rotate internal insert 20 with respect to main body 11. With this arrangement it is apparent that the elastomer seal 50 is never forced out of its total confinement within chamber 29. This allows my nozzles to be switched under high pressure without tearing or damaging the seals. In addition, this arrangement has been found effective to act as a flow shut off when one replaces one of the nozzles with a blank section.

Referring to FIG. 5, an alternate embodiment of the invention is shown in which the rotatable insert is indicated by reference numeral 60. The nozzles are identified by numerals 65 and 66. A first chamber 63 and a second chamber 64 are located behind nozzles 65 and 66. A lower hemispherical chamber 61 is located next to the fluid entrance chamber 70. In this particular embodiment there is included an elastomer ball 62 for sealing around the nozzle which is not in use. That is, fluid flowing in passage 70 flows through nozzle chamber 64 and discharges through nozzle 66. The fluid pressure forces ball 62 to seat against chamber 60 thereby preventing any fluid from leaking past nozzle 63. In this embodiment the elastomer is spherical as opposed to cylindrical. As the other portions and the rotation of the insert are identical, they will not be described again.

I claim:

1. An indexable sprayer for selecting of a fluid flow condition comprising:

a main body adaptable for connection to a source of high pressure fluid, said main body having first means for engaging a second member;

a second member having an opening therein for the flow of fluid therethrough;

a rotatable insert located in said body and between the source of high pressure fluid and the opening in said second member, said rotatable insert having at least one fluid nozzle located therein, second means located on said insert for engaging said second member, said second member including means for slidable engaging said first means and said second means, and said body for rotating said rotatable insert with respect to said body to allow an operator to position the fluid nozzle in respect to the opening in said member.

2. The invention of claim 1 wherein said main body includes a member for projecting into the source of high pressure fluid.

3. The invention of claim 1 wherein said rotatable insert includes at least two fluid nozzles.

4. The invention of claim 1 wherein an elastomer seal is located adjacent said rotatable insert.

5. The invention of claim 4 wherein said elastomer seal is spherical.

* * * * *